US008251631B1

(12) United States Patent
Greenburg et al.

(10) Patent No.: US 8,251,631 B1
(45) Date of Patent: Aug. 28, 2012

(54) SYSTEM, APPARATUS AND METHOD FOR PREPARING A QUANTITY OF DRINKING GLASSES FOR FILLING AND DISTRIBUTION

(75) Inventors: Lee E. Greenburg, Jacksonville, FL (US); Matthew Page, Ponte Vedra Beach, FL (US)

(73) Assignee: Lee E. Greenburg, Jacksonville, FL (US)

( * ) Notice: Subject to any disclaimer, the term of this patent is extended or adjusted under 35 U.S.C. 154(b) by 551 days.

(21) Appl. No.: 12/434,939

(22) Filed: May 4, 2009

Related U.S. Application Data

(60) Provisional application No. 61/050,497, filed on May 5, 2008, provisional application No. 61/144,970, filed on Jan. 15, 2009.

(51) Int. Cl.
*B65B 23/00* (2006.01)
*B08B 9/20* (2006.01)
*B08B 9/42* (2006.01)

(52) U.S. Cl. ..... 414/414; 53/299

(58) Field of Classification Search ..... 211/78; 414/171, 404–405, 414, 421, 758, 764–767; 53/299, 392

See application file for complete search history.

(56) References Cited

U.S. PATENT DOCUMENTS

| | | | | | |
|---|---|---|---|---|---|
| 1,110,256 | A | * | 9/1914 | Dalgleish | 414/405 |
| 1,331,938 | A | * | 2/1920 | McConnell et al. | 414/467 |
| 1,874,393 | A | * | 8/1932 | Vignaux, Jr. et al. | 53/247 |
| 2,447,281 | A | | 8/1948 | Schneir | |
| 2,651,425 | A | * | 9/1953 | Simon | 414/414 |
| 3,393,716 | A | | 7/1968 | Olson | |
| 3,694,993 | A | * | 10/1972 | East | 53/446 |
| 3,732,903 | A | | 5/1973 | Oates | |
| 3,791,099 | A | * | 2/1974 | Wagner | 53/447 |
| 3,811,604 | A | | 5/1974 | Perry | |
| 4,008,740 | A | | 2/1977 | Chermack | |
| 4,270,584 | A | | 6/1981 | van Lieshout | |
| 4,411,295 | A | | 10/1983 | Nutter | |
| 4,972,886 | A | | 11/1990 | Bernstein | |
| 5,293,757 | A | | 3/1994 | Nishio | |
| 5,360,309 | A | * | 11/1994 | Ishiguro | 414/404 |
| 6,557,594 | B2 | | 5/2003 | Guzman | |
| 6,612,800 | B2 | | 9/2003 | Brown | |
| 6,619,640 | B1 | * | 9/2003 | Ploski | 269/17 |
| 6,695,563 | B1 | * | 2/2004 | Guzman | 414/405 |
| 2007/0062888 | A1 | | 3/2007 | Russell | |

FOREIGN PATENT DOCUMENTS

| | | |
|---|---|---|
| JP | 3111019 | 5/1991 |

* cited by examiner

*Primary Examiner* — Gregory Adams
(74) *Attorney, Agent, or Firm* — Allen, Dyer, Doppelt, Milbrath & Gilchrist, P.A.

(57) ABSTRACT

A rotatable chassis receives first and second racks, with inverted glasses in one of the racks, such that the rotation of the chassis results in the inverted glasses sliding into an empty one of the racks in an upright position.

22 Claims, 11 Drawing Sheets

FIG. 2

SYSTEM, APPARATUS AND METHOD FOR PREPARING A QUANTITY OF DRINKING GLASSES FOR FILLING AND DISTRIBUTION

CROSS REFERENCE TO RELATED APPLICATIONS

This application claims priority to provisional applications Ser. No. 61/050,497, filed May 5, 2008 and Ser. No. 61/144,970, filed Jan. 15, 2009.

BACKGROUND OF THE INVENTION

Drinking glasses for banquet use are usually washed in racks with the glasses inverted so as to achieve better washing and to permit washing liquid to easily drain from the glasses. These racks typically hold between 16 to 36 glasses, and the glasses are rotated into the upright position by hand after washing, in order to be filled and taken to the banquet area for distribution onto tables.

U.S. Pat. No. 6,695,563 to Guzman suggests a technique for mechanically rotating a rack of washed glasses into the upright position for filling.

SUMMARY OF THE INVENTION

The present invention comprises a system, apparatus and method for preparing a quantity of drinking glasses for filling and distribution in a facile manner that reduces the risk of unsanitary contact and glass breakage, while permitting the glasses in a rack to be quickly filled and transported into a dining area for distribution.

In accordance with the present invention, the system is provided with an open-faced chassis fitted within an area of a frame or similar holding structure, with the chassis rotatable about an axis of rotation that extends through the open face. Holding means within the chassis receives a first empty rack through the open face and into a storage position, while a second holding means within the chassis receives a second rack filled with a plurality of glasses in an inverted state through the open face and into a second portion below the first rack. Means are provided for facilitating the rotation of the chassis about the axis of rotation so that the inverted glasses in the second rack slide downwardly into an upright position in the first rack.

In a preferred embodiment, the rotatable chassis is fabricated so that the first and second racks are inserted through the open face into the chassis in a horizontal direction generally parallel with the axis of rotation, with that axis passing through an area between the first and second racks. Further, the rotatable chassis is dimensioned such that an average adult operator may easily effectuate rotation of the rotatable chassis while standing in front of the open face. To this end, the rotatable chassis is fabricated such that an imaginary extension of the axis of rotation passes through the torso of an average adult operator standing in front of the open face.

Rotation of the chassis in the preferred form is facilitated with a rotatable swivel behind a rear portion, with the axis of rotation extending through the swivel.

In accordance with another aspect of the present invention, adapters having dimensions corresponding to that of the racks and a grid of openings are provided, with each opening in each adapter corresponding in size and cross-sectional dimension to the inverted glasses in the racks. The adapters are dimensioned to fit over each rack before insertion of the racks into the rotatable chassis.

In use, the preferred form of the present invention permits the rapid preparation of a quantity of drinking glasses for first filling and then distribution of the glasses by rotating the rotatable chassis about the axis of rotation so that the inverted glasses in the second rack slide through the adapters into an upright position in the first rack. To further facilitate this operation, the adapters are provided with braking means that reduces both the potential for improper alignment and breakage of the glasses.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained and advantages offered by the present invention will become more fully apparent as the description that now follows is read in conjunction with the accompanying drawings.

DETAILED DESCRIPTION OF THE PREFERRED EMBODIMENTS

The details of the system, apparatus and method of the present invention will now be described with reference to FIGS. 1-16.

Figure 1:
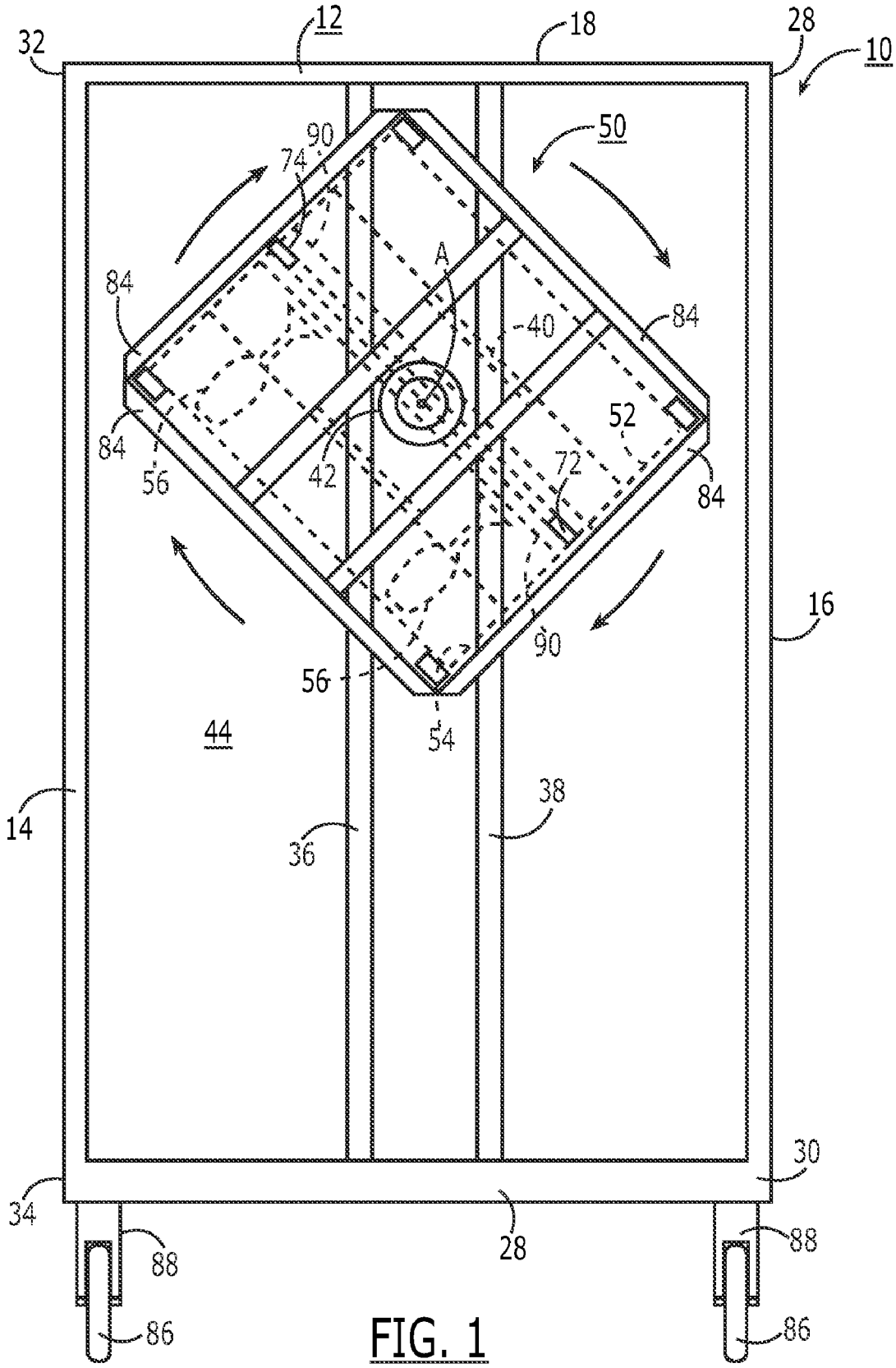
FIG. 1 is a front plan view of the system and apparatus of the present invention during rotation of the chassis.
Figure 2:
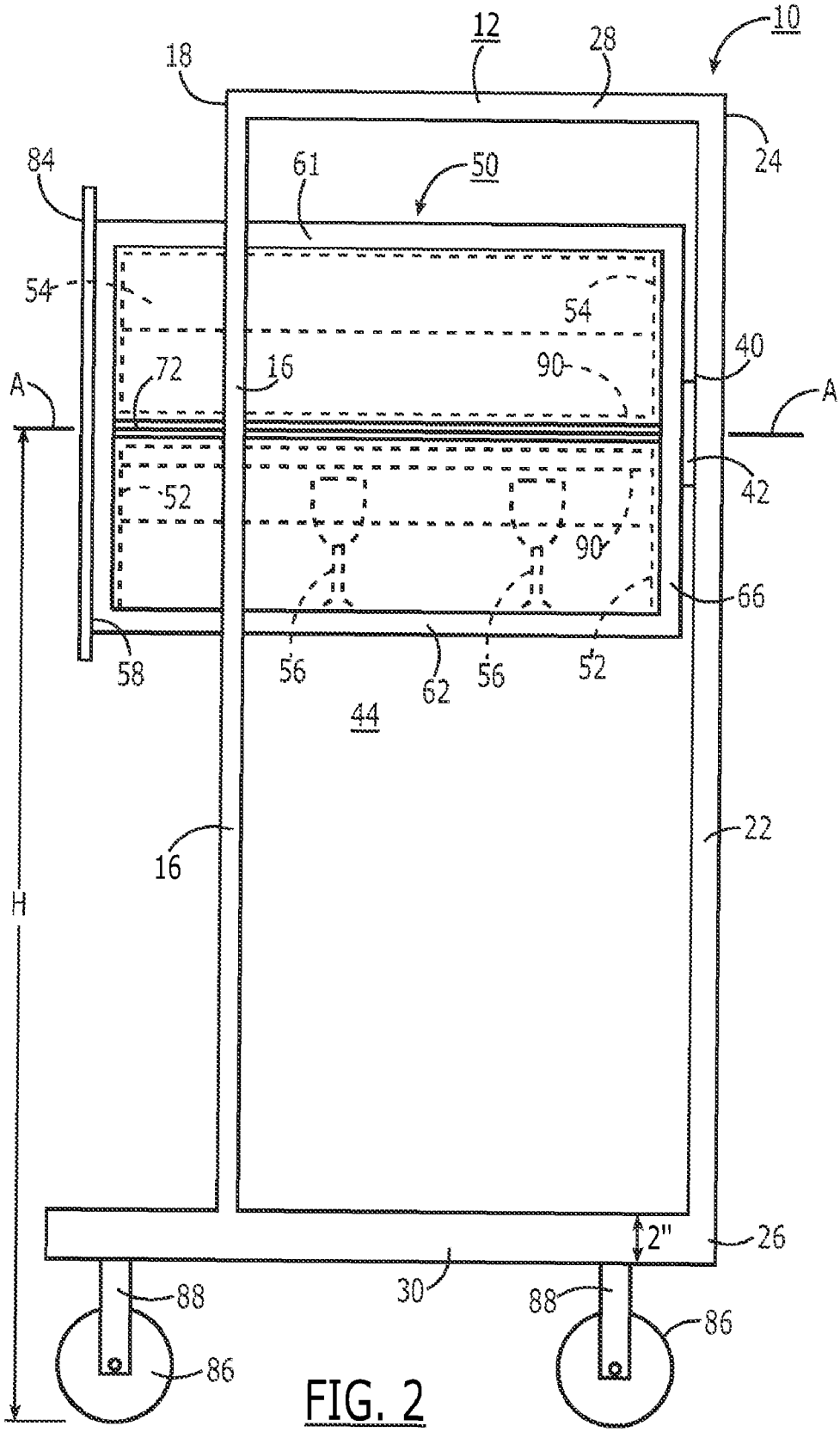
FIG. 2 is a side view of the system and apparatus shown in FIG. 1 after rotation of the chassis is completed.

First noting FIGS. 1 and 2, one embodiment of the system and apparatus, referred to generally by the reference numeral 10, comprises an open frame 12 formed of vertical and horizontal struts shown in FIGS. 1 and 2. This strut arrangement includes forward opposing vertical struts 14, 16 and forward opposed upper and lower horizontal struts 18, 20, respectively. As shown in FIG. 2, the strut arrangement further includes rear opposing vertical struts, including strut 22, it being understood that a strut on the opposite side thereof is hidden from view. Noting both FIGS. 1 and 2, opposing upper and lower side struts 28, 30 and 32, 34 extend rearwardly from the forward horizontal struts 18, 20 shown in FIG. 1.

Now noting FIG. 1, vertical support struts 36, 38 extend between the rear horizontal struts 28, 30 and are fitted and spaced between and parallel with the rear vertical struts, including strut 22. A swivel plate 40 is fitted between the support struts 36, 38 with a swivel 42 mounted to the plate 40. As thus constructed, the frame 12 defines an open area 44.

In accordance with the present invention, the system 10 comprises a rotatable chassis 50 for supporting two glass racks in a stacked relationship. Noting first FIGS. 1 and 2 and for illustrative purposes, exemplary first and second racks 52, 54 are shown in dotted lines with a quantity of glasses 56 (also in dotted lines) shown loaded into the second rack 54, and with the first rack 52 being empty of any glasses. Each of the racks 52, 54 are fitted at the top with an adapter 90 shown in dotted lines in FIGS. 1 and 2 and described in greater detail below with reference to FIGS. 11-16.

Once rotation of the chassis 50 about the axis A of the swivel 42 is undertaken as shown by the arrows in FIG. 1, the empty first rack 52 is rotated into the downward position, such that the glasses 56 fall through the second rack 54 and into corresponding openings in the first rack 52, as shown in FIG. 2, again using dotted lines to illustrate the racks 52, 54, the adapters 90 and the glasses 56. Preferably, the frame 10 and the rotatable chassis 50 are constructed so that the axis of rotation A extends between the first and second racks 52, 54 and adapters 90. Additionally, the frame 12 and the chassis 50 are dimensioned such that the position of the chassis 50 in the frame 12 is at a height H such that an average adult operator may easily effectuate rotation of the chassis 50. That is to say, an imaginary extension of the axis of rotation A passes through the torso of an average adult operator standing in front of the frame 12 and the open face 70 of the rotatable chassis 50.

One embodiment of the construction of the rotatable chassis 50 will now be described with reference to FIGS. 1-5, it being understood that a number of modifications may be made in this construction without departing from the spirit and scope of this invention.

Figure 3:
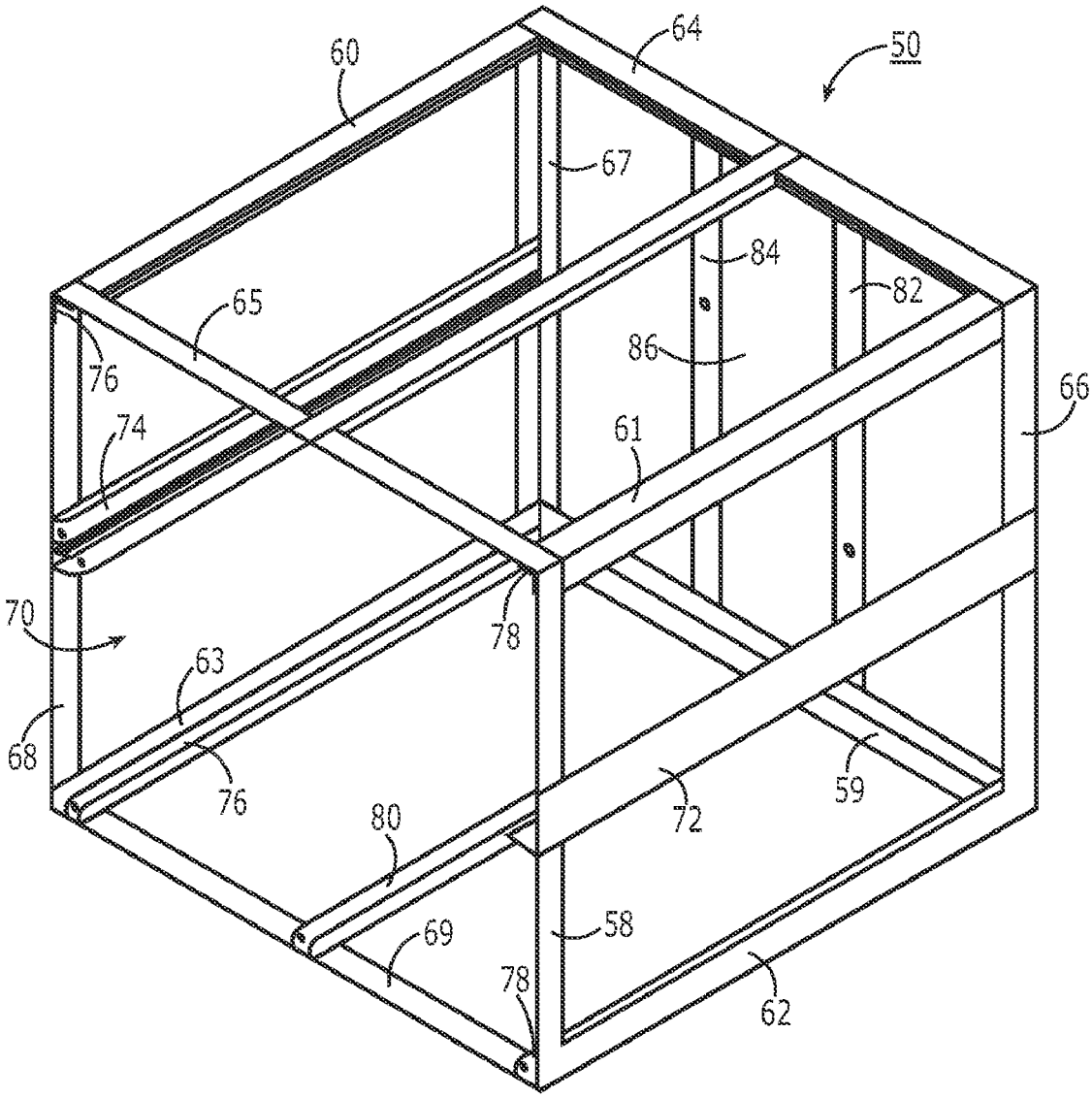
FIGS. 3, 4 and 5 are perspective, front and side views, respectively, of the rotatable chassis according to the present invention.
Figure 4:
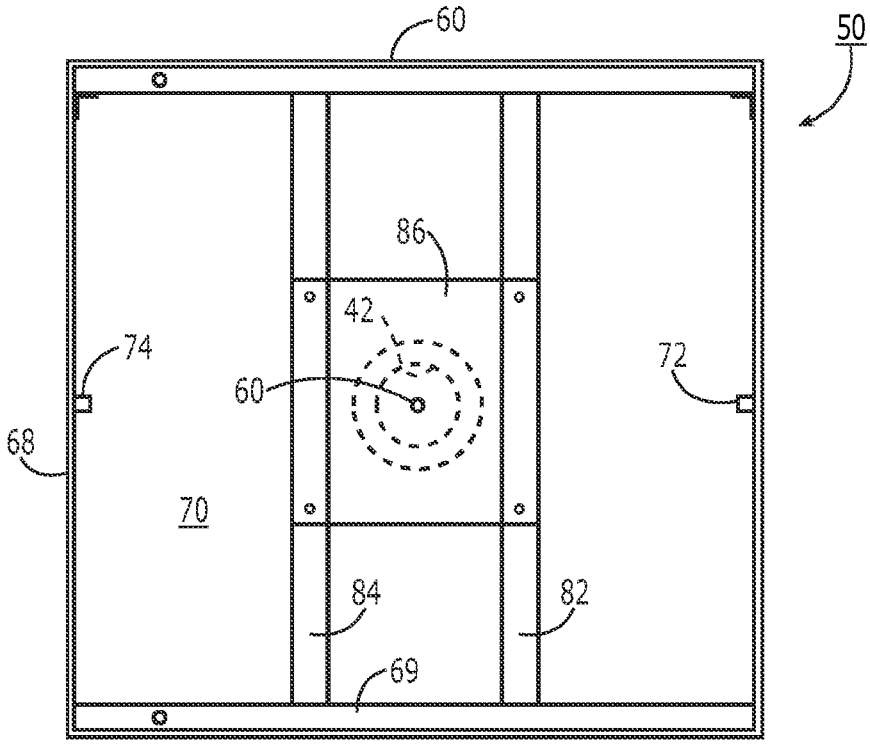
Figure 5:
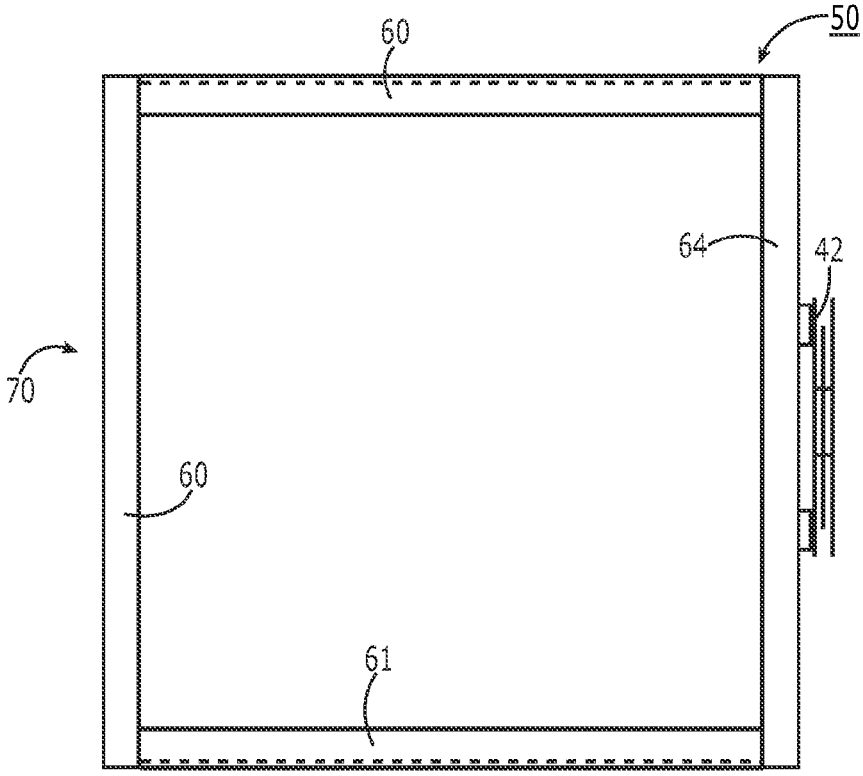

First noting FIGS. 3-5, the rotatable chassis 50 is provided with a generally orthogonal arrangement of vertical and horizontal structural elements 58-69 that defines an open-face 70 into which the first and second racks 52, 54 may be inserted. Opposing mid-section rack holders 72, 74 receive one of the racks 52, 54 in one portion of the interior of the chassis 50, and with opposing rack holders 76, 78 along the four outer horizontal structural elements 60, 61, 62 and 63. As shown in FIGS. 3 and 4, a pair of vertical structural elements 82, 84 at the rear of the rotatable chassis support a swivel plate 86; as shown in FIG. 5, the swivel 42 is attached to the rear of plate 86 with spring mounts 43 as depicted in the side view of FIG. 8, and with intermediate bearing plate 41 and bearing 43.

Figure 6:
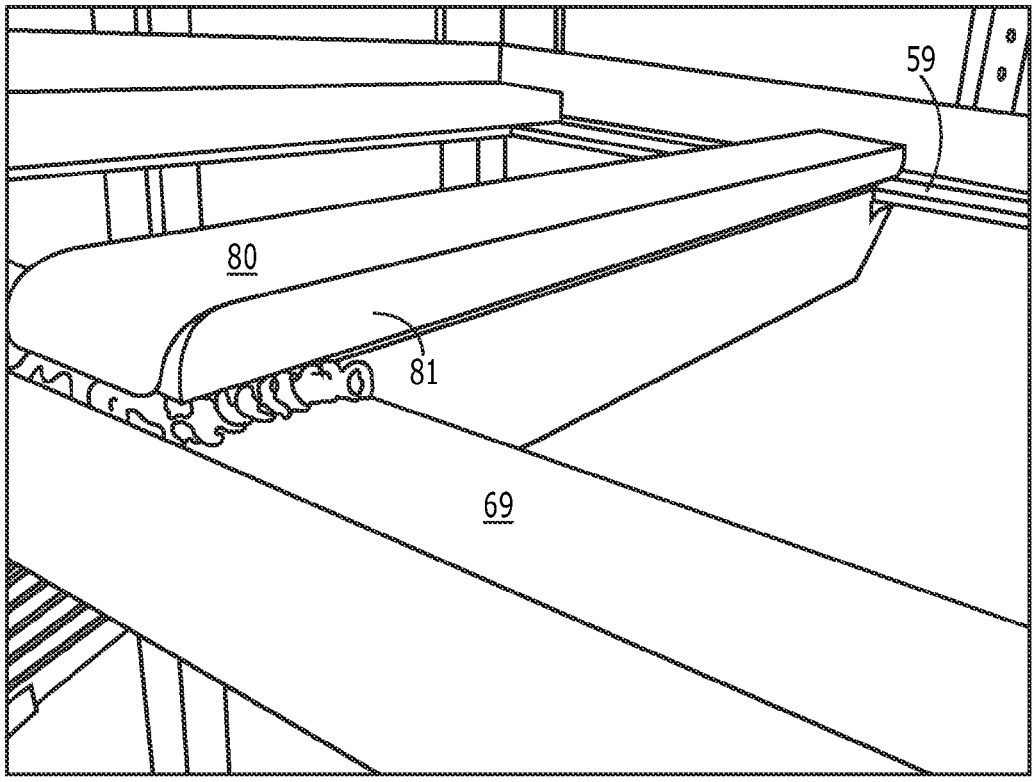
FIGS. 6 and 7 are close-up, perspective views illustrating the use of foam to dampen side-to-side and vertical movement of the rack-adapter combinations as they are installed into the chassis.
Figure 7:
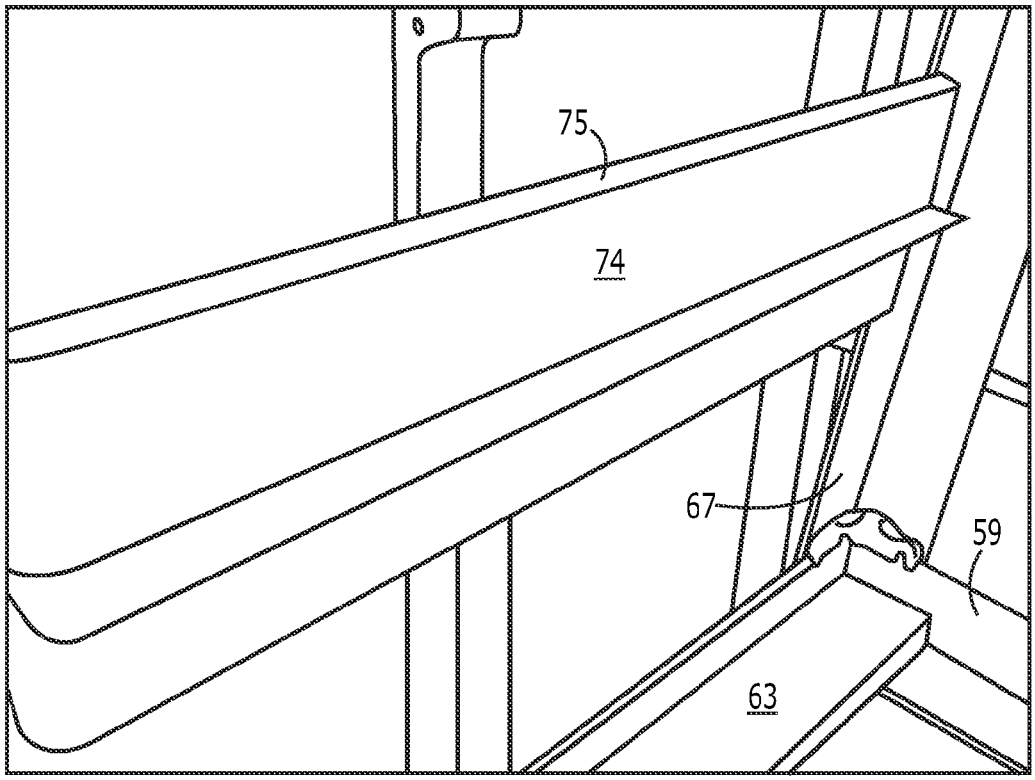
Figure 8:
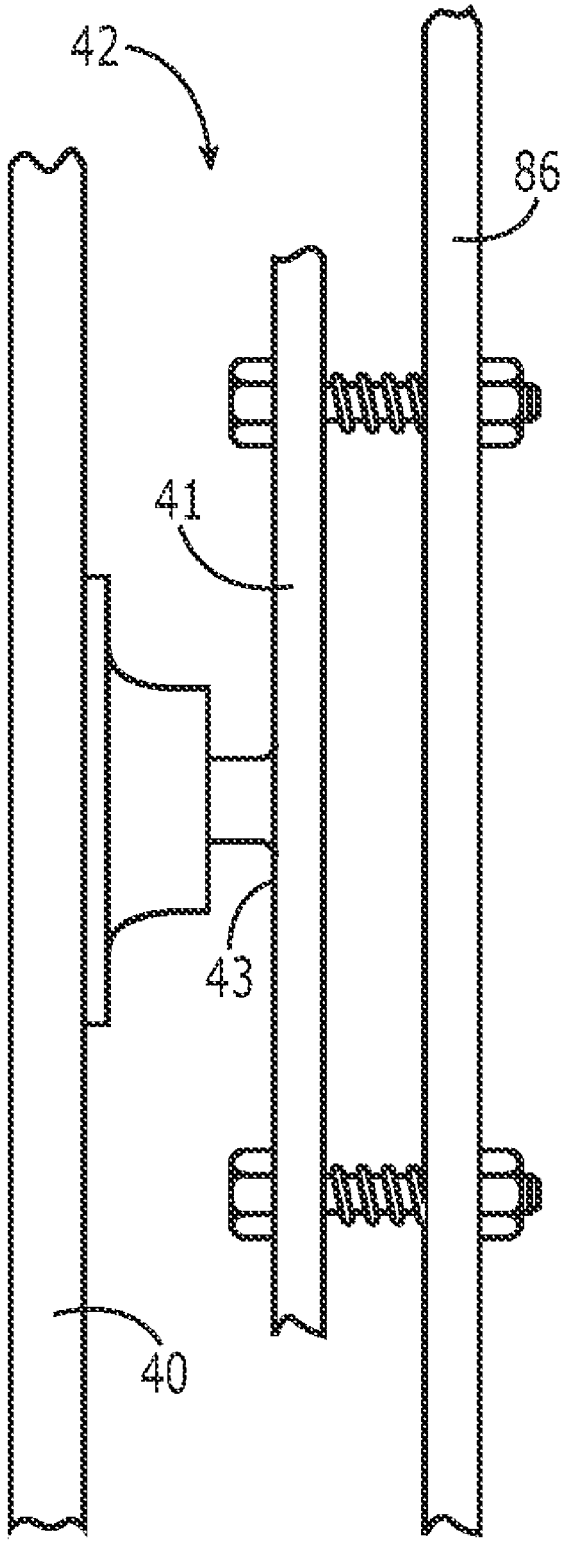
FIG. 8 is a cross-sectional side view of one embodiment of the swivel arrangement used to rotate the structure in accordance with the present invention.

As shown in FIGS. 6 and 7, the sliding surfaces across which the racks 52, 54 are installed into the chassis 50 are provided with cushioning to dampen the side-to-side and vertical movement of the racks and further reduce the likelihood of damage to the glasses. In FIG. 6, rail 80 extending from front to rear on the bottom of the chassis between structural elements 69 and 59 is provided with a cushioning foam layer 81. In FIG. 7, sliding element 74 is provided with foam cushion 75, it being understood that such cushioning is provided to all of the corner and mid-section sliding elements.

Figures 9, 10:
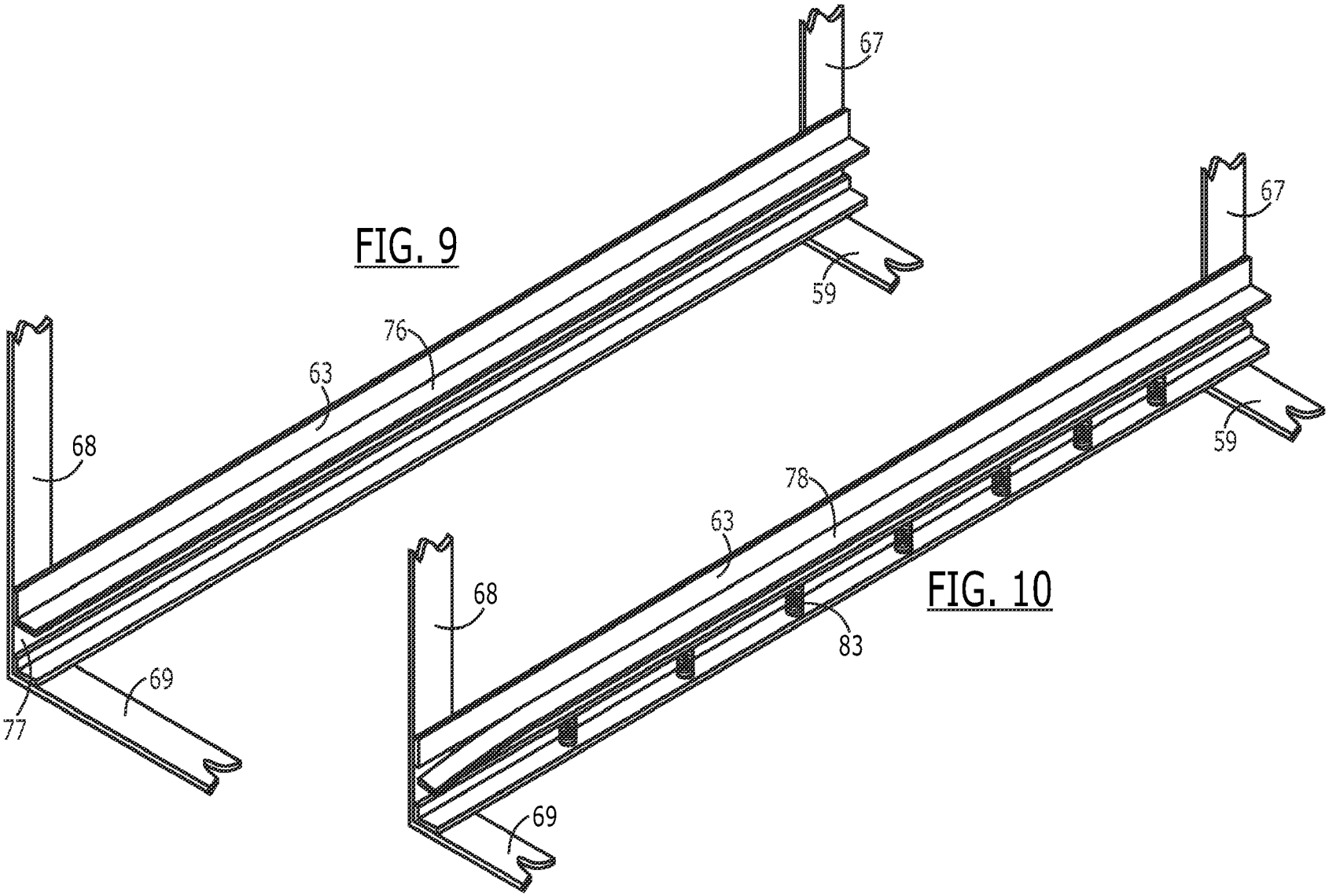
FIGS. 9 and 10 are perspective partial illustrations of different embodiments of the holding means used to receive the racks in accordance with the present invention.

FIG. 9 depicts the details of another embodiment of the rack holder 76, including a space L-shaped bracket 77 fitted along the corresponding structural element (in the case of FIG. 9, structural elements 63). An alternative form of the rack support is shown in FIG. 10, utilizing a bracket 78 that is mounted upon springs 83.

Figure 11:
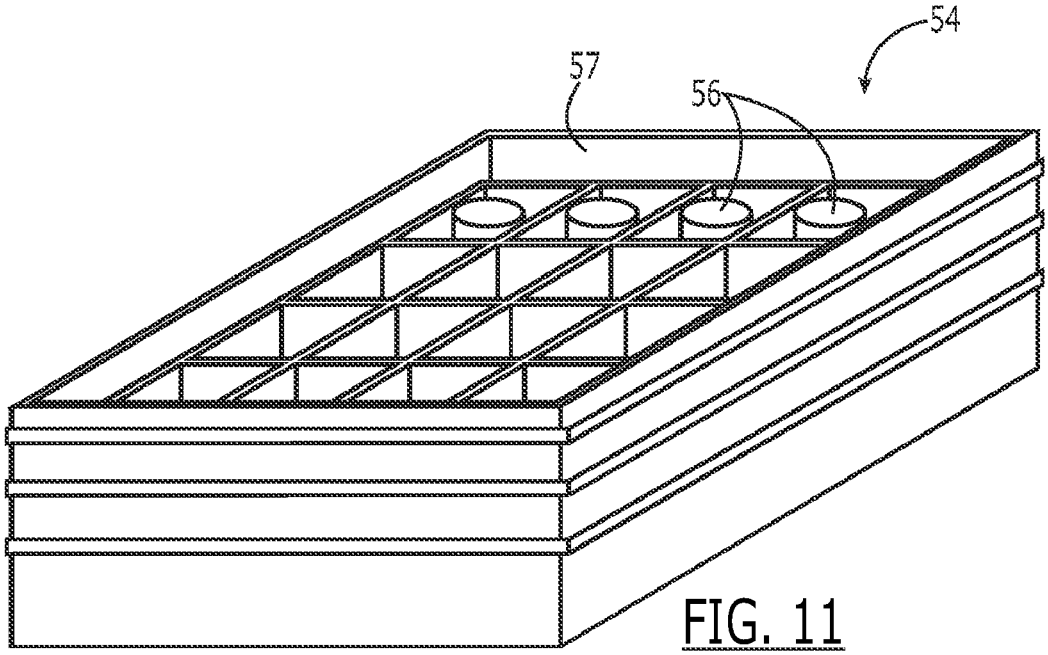
FIG. 11 is a perspective view of a rack useful with the present invention.
Figure 12:
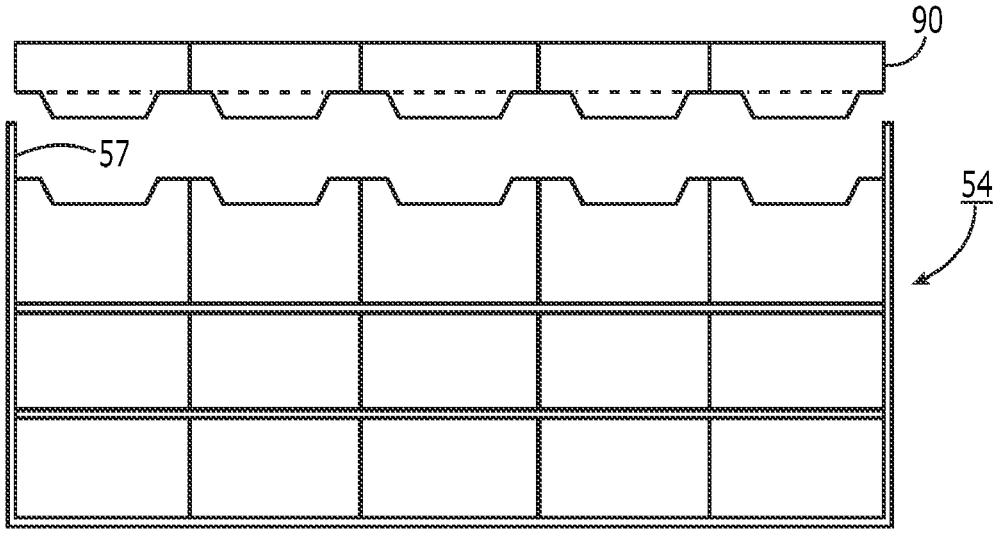
FIG. 12 is a cross-sectional side view illustrating the manner in which an adapter is fitted together with the rack of FIG. 11.
Figure 13:
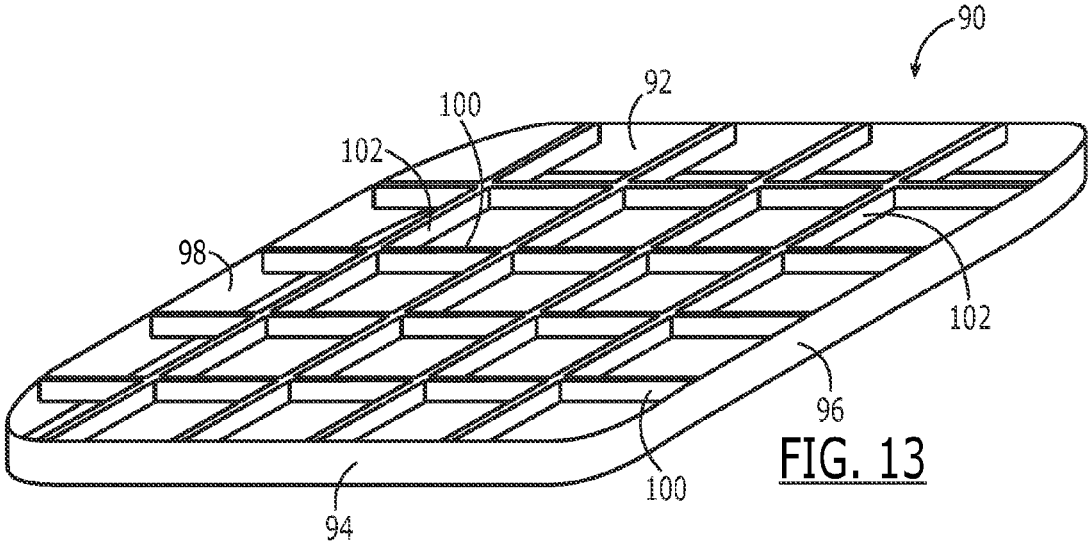
FIG. 13 is a perspective view of an adapter rack of the present invention.

FIG. 11 is a perspective illustration of one of the racks, for example rack 54, with glasses 56 positioned therein. Typically, the rack 54 is provided with an upper area of each side wall, including area 57 which is suitable for insertion of an adapter 90, such as that shown in FIGS. 12 and 13. The adapter 90 includes side walls 92, 94, 96 and 98 that are dimensioned to fit on top of the rack 54 within the volume defined by the extending dimension shown as element 57 in FIG. 11. The adapter 90 comprises a grid formed of longitudinal grid elements 100, 102 that are dimensioned to correspond to the openings in the rack 54 for glasses 56.

Figure 14:
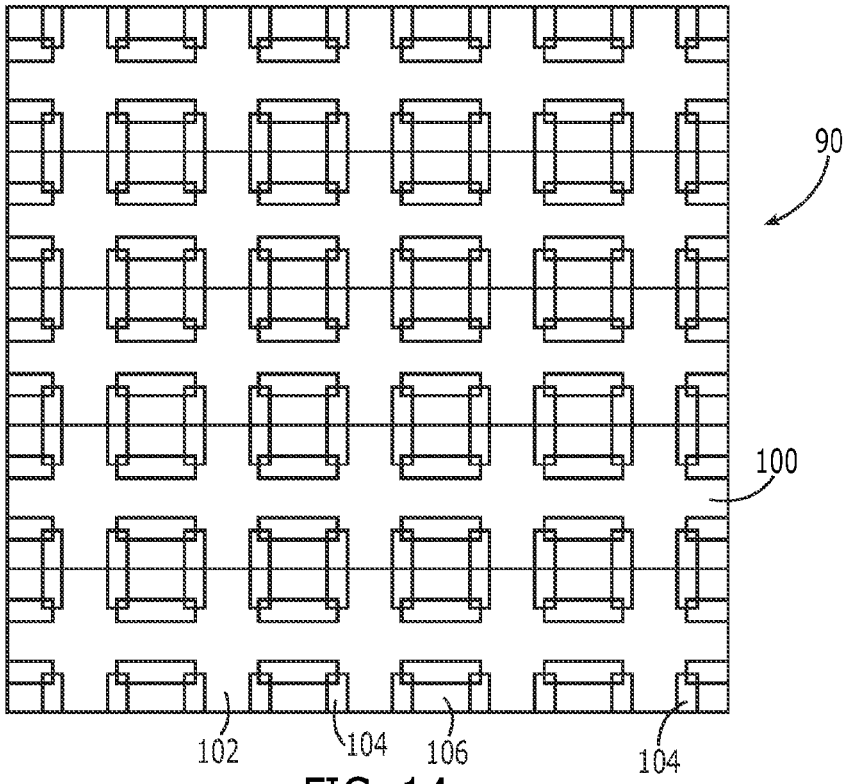
FIGS. 14 and 15 are, respectively, top plan and perspective illustrations of the brake feature of the adapter rack.
Figure 15:
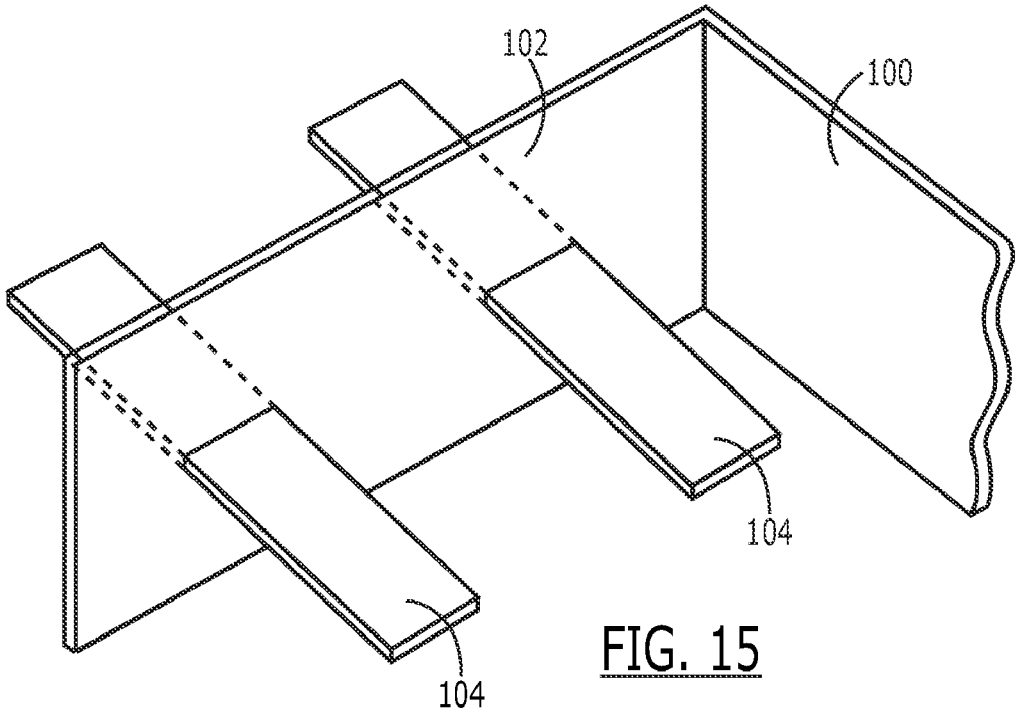

In accordance with another aspect of this invention, means are provided for customizing the dimension in the racks to accommodate for differences in the thickness, length and width and depending upon the weight and diameter of specific glasses to be handled by the system 10. To this end, each rack 90 is provided with brakes 104 along the periphery of each glass opening 106, the details of which are shown in FIG. 15, it being understood that the brakes 104 may be positioned along each side of the opening 106 as shown in FIG. 14.

Figure 16:
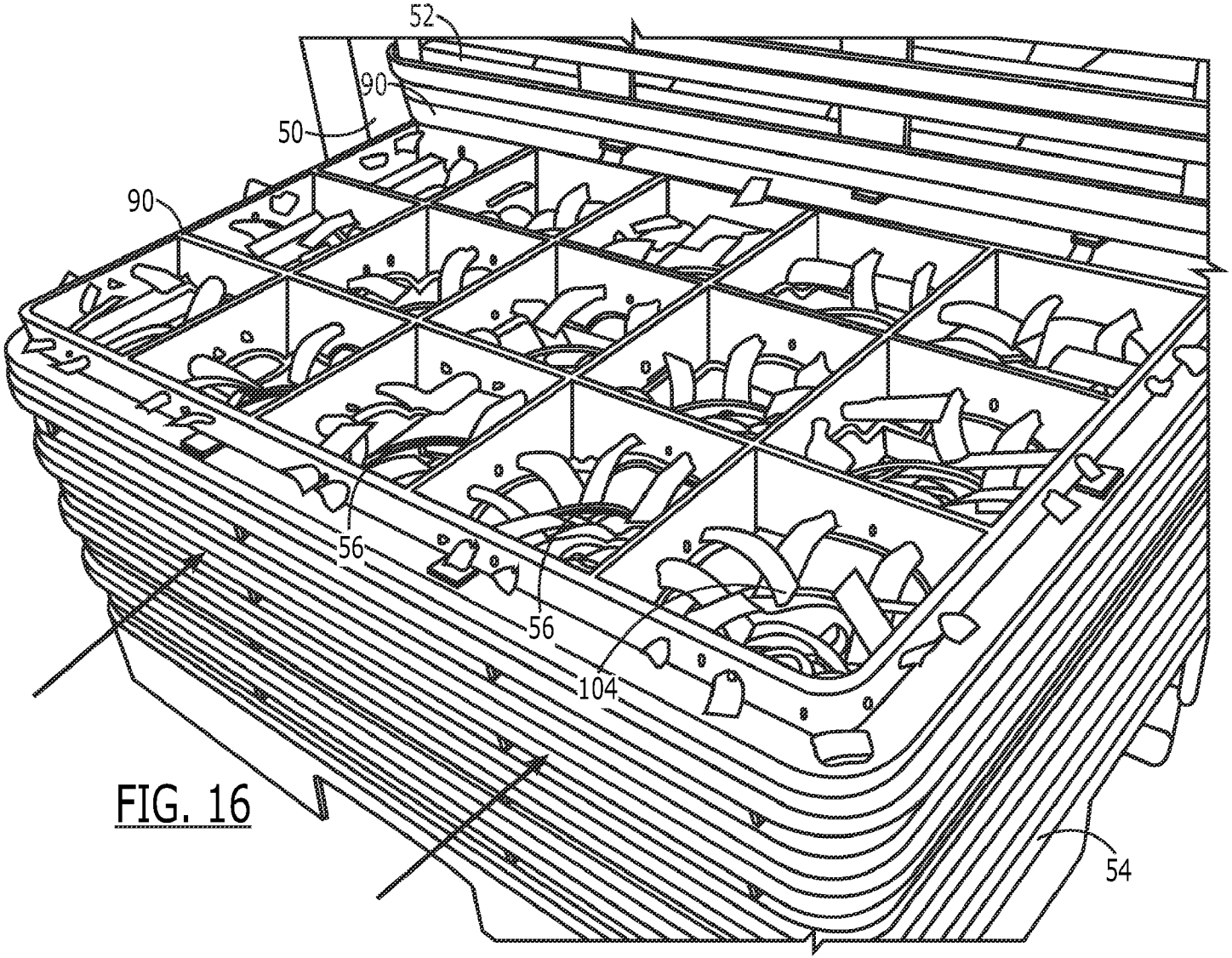
FIG. 16 is a perspective view of rack 54 and adapter 90 sliding into the chassis 50.

In use, a first empty rack 52 is extended through the open face 70 of the chassis 50. Thereafter, a second, full rack 54 filled with inverted glasses 56 is extended through the open face 70 of the chassis 50 below the first rack 52 as shown in FIG. 16. The chassis 50 is then rotated about the axis of rotation A so that the inverted glasses in the second rack 54 slide into the upright position in the first rack 52, as shown in FIG. 2. Again, the brakes 104 in each adapter 90 significantly reduce the likelihood of damage to the glasses during the "flipping" of the two racks 52, 54 about the axis of rotation. It will be appreciated that an average adult operator standing in front of the open face 70 of the rotatable chassis 50 can easily rotate the chassis 50 about the axis of rotation A by grasping the handles 84 and then guiding the chassis 50 manually through the 180° rotation in order to achieve movement of the glasses from the second rack 54 to the first rack 52. Alternatively, the rotation may also be effectuated automatically by use of a motor arrangement.

Once the glasses 56 have been moved from the second rack 54 to the first rack 52, the first rack may then be removed and the glasses 56 filled with a beverage and the filled rack 52 taken to the banquet area for distribution. The second rack 54, now empty, is positioned in the upper portion of the rotatable chassis 50. A third, full rack of inverted glasses may then be inserted into the rotatable chassis 50 below the second rack 54, and the rotation of the chassis again executed and so forth as needed. It will of course be appreciated by those skilled in the art that a large quantity of glasses may very quickly be prepared for filling and distribution utilizing the system and method of the present invention.

The embodiments of the system, apparatus and method of the present invention as set out above are for purposes of illustration only and by way of example, and the scope of these inventions are not limited to the exact details of construction and use but only by the appended claims.

What is claimed is:

1. A method for rapidly preparing a quantity of drinking glasses for first filling and then distributing the glasses, the method comprising the steps of:

providing a frame having a chassis with an open face, the chassis rotatable within the frame about an axis of rotation;

inserting a first, empty rack through the open face of the rotatable chassis and into holding means in a first portion of the chassis;

inserting a second rack filled with inverted glasses through the open face of the rotatable chassis into holding means in a second portion therein below the first rack;

providing a pair of adapters each having dimensions corresponding to that of the racks and a grid of openings, each opening corresponding in size and cross-sectional dimension to the inverted glasses in the second rack;

fitting one of the adapters over the second rack before inserting the second rack into the rotatable structure; and rotating the rotatable chassis about the axis of rotation so that the inverted glasses in the second rack slide into an upright position in the first rack.

2. The method recited in claim 1 further comprising the step of orienting the holding means so that the first and second racks are inserted into the rotatable chassis in a direction generally parallel with the axis of rotation.

3. The method recited in claim 2 further comprising the step or orienting the rotatable chassis relative to the frame so that the axis of rotation extends generally through an area between the first and second racks.

4. The method recited in claim 1 further comprising the step of dimensioning the frame and the position of the rotatable chassis in the frame so that an average adult operator may easily effectuate rotation of the chassis while standing in front of the open face.

5. The method recited in claim 4 further comprising the step of dimensioning the frame and the rotatable chassis so that an imaginary extension of the axis of rotation passes through the torso of the average adult operator standing in front of the open face.

6. The method recited in claim 1 further comprising the step of fitting a rotatable swivel between a rear portion of the rotatable chassis and a rear portion of the frame to effectuate rotation of the rotatable structure.

7. The method recited in claim 6 further comprising the step of orienting the frame and the rotatable chassis so that the axis of rotation extends through the swivel.

8. The method recited in claim 1 further comprising the step of removing the one adapter from the second rack after completing the step of rotating the rotatable structure about the axis of rotation.

9. The method recited in claim 1 further comprising the step of cushioning movement of the first and second racks while being inserted into the chassis and during rotation of the chassis.

10. A method for permitting a quantity of drinking glasses to be prepared for filling and distribution, the method comprising the steps of:

providing a chassis with an open face;

providing first and second racks both having substantially identical dimensions and each adapted to receive a quantity of drinking glasses;

receiving the first and second racks through the open face into respective first and second holding positions therein;

fitting a pair of adapters between the first and second racks to facilitate sliding of glasses between the racks while reducing the risk of breakage of the glasses; and rotating the chassis about an axis of rotation that extends between the first and second racks and outwardly through the open face of the chassis.

11. The method recited in claim 10 further comprising supporting the chassis while being rotated such that an average adult operator may easily effectuate rotation while standing in front of the open face.

12. The method recited in claim 11 wherein the dimensions of the chassis are provided such that an imaginary extension of the axis of rotation passes through the torso of an average adult operator standing in front of the open face.

13. The method recited in claim 12 further comprising the step of rotating the chassis with a rotatable swivel mounted opposite the open face.

14. The apparatus recited in claim 10 further comprising the step of fitting braking means with each adapter to slow movement of glasses between the racks.

15. A method for permitting a quantity of drinking glasses to be prepared for filling and distribution, the method comprising the steps of:

providing an upstanding frame;

fitting a chassis with an open face within the frame and rotatable about an axis of rotation;

providing first and second racks, each rack dimensioned to receive a quantity of drinking glasses;

providing first holding means within the chassis for receiving the first rack in an empty condition through the open face and into a storage position therein;

providing a quantity of the drinking glasses;

providing second holding means for receiving the second rack filled with the quantity of glasses in an inverted state through the open face and into a second portion within the chassis below the first rack;

fitting each of the first and second holding means with low friction sliding surfaces within the chassis for receiving the respective racks and cushioning means between the low friction sliding surfaces and the chassis to dampen side-to-side and vertical movements of the racks; and rotating the chassis about the axis of rotation so that the inverted glasses in the second rack slide into an upright position in the first rack.

16. The method recited in claim 15 further comprising the step of orienting the frame, the chassis and the first and second holding means so that the first and second racks are insertable into the chassis in a horizontal direction generally parallel with the axis of rotation.

17. The system recited in claim 16 further comprising the steps of dimensioning and constructing the frame, the chassis and the first and second holding means so that the axis of rotation extends generally through an area between the first and second racks.

18. The method recited in claim 17 further comprising the step of dimensioning the frame and the chassis such that the position of the chassis in the frame is such that an average adult operator may easily effectuate rotation of the chassis while standing in front of the open face.

19. The method recited in claim 18 further comprising the step of dimensioning the frame and the chassis such that an imaginary extension of the axis of rotation passes through the torso of an average adult operator standing in front of the open face.

20. The method recited in claim 15 further comprising the step of providing a rotatable swivel behind a rear portion of the chassis and a rear portion of the frame to effectuate rotation of the structure.

21. The method recited in claim 20 further comprising the step of extending the axis of rotation through the swivel.

22. The method recited in claim 15 further comprising:

providing a pair of adapters each having dimensions corresponding to that of the racks and a grid of openings, each opening corresponding in size and cross-sectional dimension to the inverted glasses in the second rack; and wherein dimensioning each adapter to fit over one of the racks before insertion into the chassis.

* * * * *